US005648591A

United States Patent [19]

Donecker et al.

[11] Patent Number: 5,648,591

[45] Date of Patent: Jul. 15, 1997

[54] TOXIC MATERIAL DISPOSAL

[75] Inventors: Peter Donecker, Bentley; Paul Gerard McCormick, Nedlands; Robert Street, Nedlands; Sally-Anne Rowlands, Nedlands, all of Australia

[73] Assignee: University of Western Australia, Perth, Australia

[21] Appl. No.: 454,325

[22] PCT Filed: Dec. 17, 1993

[86] PCT No.: PCT/AU93/00660

§ 371 Date: Aug. 16, 1995

§ 102(e) Date: Aug. 16, 1995

[87] PCT Pub. No.: WO94/14503

PCT Pub. Date: Jul. 7, 1994

[30] Foreign Application Priority Data

Dec. 18, 1992 [AU] Australia ..... PL6474
May 28, 1993 [AU] Australia ..... PL9085

[51] Int. Cl.[6] ..... A62D 3/00

[52] U.S. Cl. ..... 588/205

[58] Field of Search ..... 588/205, 200; 208/262.5, 262.1; 423/659, DIG. 15

[56] References Cited

U.S. PATENT DOCUMENTS

| | | | |
|---|---|---|---|
| 4,345,983 | 8/1982 | Wan | 204/158 R |
| 4,666,696 | 5/1987 | Schultz | 423/659 |
| 5,053,142 | 10/1991 | Sorenson et al. | 210/742 |
| 5,064,526 | 11/1991 | Rogers et al. | 208/262.5 |

FOREIGN PATENT DOCUMENTS

| | | |
|---|---|---|
| 0257893 | 3/1988 | European Pat. Off. . |
| 0 444 392 A2 | 9/1991 | European Pat. Off. . |
| 33 11 100 A1 | 9/1984 | Germany . |
| 1813733 | 5/1993 | Russian Federation . |
| WO90/07012 | 6/1990 | WIPO . |

OTHER PUBLICATIONS

Patent Abstracts of Japan, C–77, p. 2762, JP.A.52–78855 (Shimazu Seisakusho K.K.) 7 Feb. 1977 (Jul. 02, 1977).

Patent Abstracts of Japan, C–78, p. 1819, JP.A.53–64667 (Sumitomo Denki Kogyo K.K.) 6 Sep. 1978 (Jun. 9, 1978).

PCT International Search Report for International Application No. PCT/AU 93/00660.

*Primary Examiner*—Deborah Jones
*Assistant Examiner*—Amy M. Harding
*Attorney, Agent, or Firm*—Merchant, Gould, Smith, Edell, Welter & Schmidt, P.A.

[57] ABSTRACT

A process for the treatment of toxic materials, for example, inorganic compounds, halogenated organic compounds such as polychlorinated biphenyls (PCBs), dioxin and dichlorodiphenyl trichloroethane (DDT) and chemical weapons such as Sarin and mustard. The process is based on the discovery that mechanical activation can induce chemical reactions which break down the molecular structure of toxic materials and form products which are simple, non-toxic compounds. The process involves subjecting a mixture of a toxic material and a suitable reagent to mechanical activation to produce a non-toxic end product or products. Mechanical activation is typically performed inside a mechanical mill, for example, a ball mill. Ball milling of various toxic materials with appropriate reagents was found to result in virtual total destruction of the toxic starting material.

16 Claims, 4 Drawing Sheets

TOXIC MATERIAL DISPOSAL

FIELD OF THE INVENTION

The present invention relates to a process for the treatment of toxic materials and relates more particularly, though not exclusively, to a process for the treatment of halogenated organic compounds such as poly-chlorinated biphenyls (PCBs), dichlorodiphenyl trichloroethane (DDT), monochlorobenzene and chemical weapons such as Sarin and mustard.

BACKGROUND TO THE INVENTION

There is today increased public awareness and improved scientific understanding of the hazards to health and the environment of many synthetically produced chemicals, insecticides, herbicides and other toxic materials. Of particular concern due to their high toxicity and persistence are halogenated organic compounds such as PCBs, Dioxin, DDT, monochlorobenzene, dichlorophenol, pentachlorphenol, Dieldrin, Aldrin, 2,4-D, 2,4,5-T, and other compounds such as Paraquat, Diquat, Phorate, Bromicide, carbamates and Atrazine. There is therefore a need for effective methods of disposing of such toxic materials. The wide spread use of PCBs as dielectric fluid additives in transformers and other electrical equipment, due to their excellent insulating properties, present a particularly serious disposal problem.

In some countries stockpiles of chemical weapons, which include organophosphorus nerve agents and mustards, await a suitable means of disposal. This disposal is required under the terms of the Chemical Weapons Convention of 1993. The disposal of such materials presents a particularly severe problem, since accidental dispersal could result in enormous loss of life. A disposal system with extremely low risk factors is required for this application. A deadline for weapon destruction of Dec. 31, 2004 has been set by the Chemical Weapons Convention.

Currently proposed methods of disposing of toxic materials typically involve high temperature incineration, biochemical or chemical treatment. High temperature incineration seeks to destroy toxic waste materials by converting them to gaseous products. Any toxic gases, such as hydrogen chloride, must then be removed from the effluent gas before it is released to the atmosphere. If operating conditions are not closely controlled, there is a possibility that toxic materials will be released into the environment either through incomplete destruction of the original materials or through creation of new materials in the incinerator or through inefficient gas cleaning. Control systems are required to regulate the fuel addition, air flow, temperature, flame, gas composition, scrubbing liquor flow and so on. Back-up systems to deal with loss of electrical power are also required. These systems comprise a very large number of individual components, both electrical and mechanical, and the failure of any one of them may lead to the immediate loss of integrity of the system as a whole. Failure of the system could lead to widespread dissemination of toxic material into the surrounding environment.

Chemical treatment results in chemical decomposition of the toxic materials through the action of suitable reagent mixtures. U.S. Pat. No. 5,064,526 to Rogers et al discloses a method for both the decomposition and removal of halogenated and non-halogenated organic compounds contained in a contaminated medium by the use of an alkali or alkaline earth carbonate or bicarbonate or hydroxide, a hydrogen donor such as an oil and a catalytic form of carbon such as a carbohydrate. This process is conducted at elevated temperatures, requiring the application of heating and cooling systems, fire prevention systems, power failure systems and gas emission systems. These systems comprise a multiplicity of components and interconnections, each of which is the subject of possible failure, and the malfunction of anyone of them may lead to a loss of the integrity of the system as a whole. In the event of a failure leading to a fire, there is potential for widespread dissemination of toxic material into the surrounding environment.

Processes involving the use of baths of molten metal or salt, plasma arcs or other operating conditions departing significantly from ambient suffer from the common disadvantage of requiring complex systems to ensure containment, maintenance of optimum operating conditions, and prevention of emissions. Risk of failure tends to increase as the number of overall system components and interconnections increases and the potential for catastrophic emission of toxic materials tends to increase with departure from ambient conditions.

From a public, safety and commercial liability viewpoint, the acceptability of any process for toxic waste disposal is largely dependent on the risk of system failure and the potential consequences of such failure. The high risk potential of the proposed processes referred to above limits their acceptability and thus limits their utility.

Furthermore, the perceived risks associated with incineration have resulted in such widespread public opposition that any process resembling incineration in any way is liable to be rejected on the basis of its similarity rather than on a scientific assessment.

Biological methods of disposal of toxic materials do not suffer from most of the above-mentioned disadvantages, but such methods are not able to treat concentrated forms of toxic materials directly.

Toxic waste materials may not be well characterised and may contain mixtures of organic and inorganic materials, and the toxic materials may be contained in corroded drums or within electrical components. It is desirable therefore that a process be capable of disposing of a wide range of materials and containers in a single stage, thus eliminating the risks associated with having a number of separate handling stages. Many of the processes proposed to date are not capable of handling toxic organic compounds when they are mixed with inorganic materials such as arsenic trioxide, nor are they capable of accepting the containers holding the toxic wastes.

The process of the invention is based on the discovery that mechanical activation can induce chemical reactions which break down the molecular structure of toxic materials and form products which are simple, non-toxic compounds. It was previously not known to use mechanical activation for the destruction of toxic materials, nor was it known that complex organic molecules could be completely destroyed by mechanical activation.

Mechanical activation involves the use of mechanical energy to increase the chemical reactivity of a system so as to induce mechanochemical reactions which involve changes in chemical composition as a consequence of the applied mechanical energy. For example, one form of mechanical activation is mechanical alloying by which alloys are formed from pure starting materials by milling the constituents in a high energy ball mill. During milling the energy imparted to the reactants through ball/reactant collision events causes the starting materials to react, enabling the formation of an alloy without the need for melting or high temperatures. Another form of mechanical activation, described in International Application No. PCT/AU89/00550, is concerned with a chemical reduction process involving mechanically activated chemical reduction of reducible metal compounds for manufacturing metals, alloys or ceramic materials.

The use of mechanical activation to synthesise certain types of chemical compounds, such as organometallic compounds, is described in U.S. Pat. No. 2,416,717 by Shaw. An example of the kind of reaction described by Shaw is the so-called Grignard type of reaction which is used to synthesise more complex organic compounds from simpler compounds. When used to carry out a Grignard type of reaction, mechanical activation by continuously cutting chips from a metal used to make a Grignard type reagent may improve the reactivity of the reagents and may be used to control and regulate the rate at which the chemical reaction proceeds. However it was not appreciated that mechanical activation could also be used to break down complex organic compounds into simple inorganic substances.

Mechanochemical degradation of polyvinyl chloride (PVC) during mechanical grinding in a vibrational mill has also been investigated. PVC composites which contain inorganic fillers have been subjected to grinding to help characterise the effect of the filler on the stability of the PVC composite. The degree of polymerisation and dehydrochlorination of the PVC was found to vary with the addition of calcium compounds such as $CaSO_4.2H_2O$, $CaCO_3$ and $Ca(OH)_2$. However this research into the effects of mechanical grinding on a polymer powder (PVC) did not anticipate or in any way consider the use of mechanical activation for the destruction of toxic materials such as halogenated organic compounds into simple inorganic compounds such as carbon.

SUMMARY OF THE INVENTION

The present invention was developed with a view to providing an efficient and environmentally acceptable process for the treatment of toxic materials.

According to the present invention there is provided a mechanochemical process for the treatment of toxic material, the process comprising:

subjecting a mixture of the toxic material and a suitable reagent to mechanical activation to increase the chemical reactivity of the reactants such that a chemical reaction occurs which produces a non-toxic end product or products.

Typically the toxic material is a halogenated organic compound, more typically a chlorinated hydrocarbon such as, for example, a PCB or DDT compound. The toxic material may be a mixture of a toxic and a non-toxic compound or materials.

Any reagent which is capable of chemically reacting with the toxic material may be suitable. The reagent may be a solid, liquid or gas, and two or more suitable reagents may be used if desired. Suitable reagents may include oxidising agents such as, for example, iron oxide, manganese dioxide and oxygen. Alternatively the reagent may be a reducing agent such as, for example, aluminium metal, iron metal and zinc metal. Reductants which either break down the entire molecule or react selectively to remove chlorine may be used. Other suitable reagents may also be employed to dispose of particular toxic materials, for example, sodium hydroxide, graphite, red mud, lime or quicklime, water, carbon dioxide, calcium oxide, copper oxide, aluminium oxide and magnesium oxide.

The reagent may be one of several substances introduced into the mixture to promote reactivity during mechanical activation, and that may be activated or pretreated in some other way to enhance the reaction rate.

In a preferred form of the invention, mechanical activation is performed inside a mechanical mill, for example, a ball mill. Mechanical activation occurs in a ball mill when grinding media, typically steel or ceramic balls, are kept in a state of continuous relative motion with a feed material by the application of mechanical energy, such that the energy imparted to the feed material during ball-feed-ball and ball-feed-liner collisions is sufficient to cause mechanical activation.

Throughout the remainder of the specification reference will be made to the process of the invention being carried out inside a mechanical mill. Any of the commercially available mills of this type may be suitable. Examples of this type of mill are nutating mills, tower mills, planetary mills, vibratory mills, attritor mills and gravity-dependent-type ball mills. Closed circuit recycling of the mill contents between the mill and an external vessel may be desirable. The mill contents may also be passed through a post-milling extraction facility if necessary.

It will be appreciated that the mechanical activation may also be achieved by any suitable means other than ball milling. For example, mechanical activation may also be achieved using jet mills, rod mills, roller mills or crusher mills. Throughout the specification, the term "mechanical activation" includes any process which involves the use of mechanical energy to increase the chemical reactivity of the reactants so as to induce mechanochemical reactions, which are chemical reactions that occur as a consequence of the applied mechanical energy.

In order to facilitate a better understanding of the invention preferred embodiments of the process and examples of mechanochemical reactions according to the process will now be described in detail, by way of example only.

BRIEF DESCRIPTION OF ACCOMPANYING DRAWINGS

DETAILED DESCRIPTION OF PREFERRED EMBODIMENTS

Figure 1:
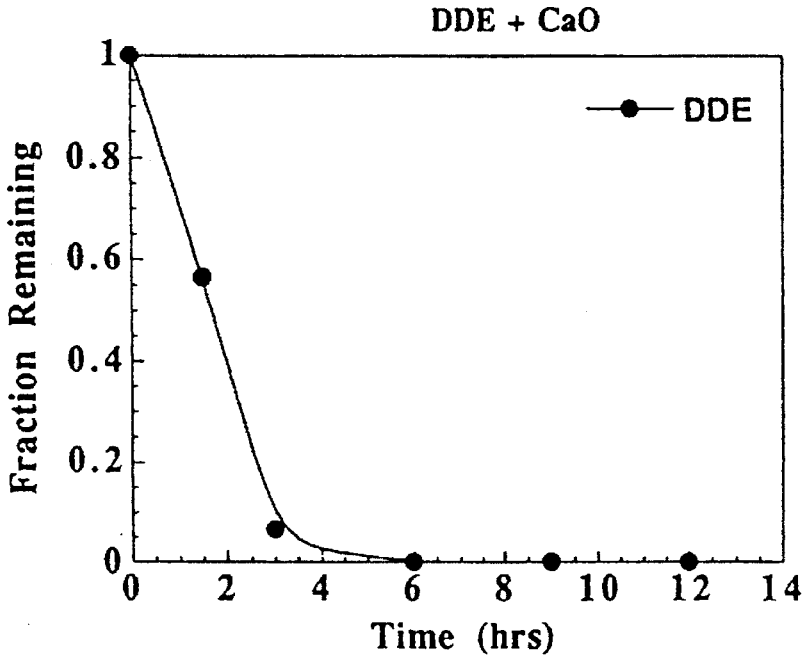
FIG. 1 illustrates graphically the fraction of DDE remaining as a function of milling time when processing DDE with CaO in a ball mill.

In the process of the invention the toxic materials are typically placed inside a mechanical mill together with a suitable reagent(s), and subjected to milling action. As a consequence of mechanical activation associated with milling, collision events involving the reagents and the grinding media occur which induce the toxic materials to enter into reaction with the reagent materials to form non-toxic end products. Additionally, it may be necessary to overcome an activation energy barrier for the reaction to proceed. In the process according to the invention, the activation energy is typically supplied by the action of a ball mill in providing mechanical activation.

The processing parameters depend on the nature of the toxic materials treated and the mechanical activation employed. For illustrative purposes, the following parameters for rotary ball milling are preferred:

Collision Energy: 0.01 to 100 Joules

Ball/Reactant Mass Ratio: 2:1–50:1

Milling Time: typically less than 72 hours, more typically less than 24 hours.

Atmosphere: air or inert gas, for example, argon or nitrogen plus any reactant gases.

In the process of ball milling the liquid/solid/gaseous reactants, including the toxic materials and suitable reagents, collide with each other and the grinding media. At least one of the reactants should be a solid and the reactivity of the reactants increases due to the increase in reaction area resulting from the decrease in particle size of the solid phase associated with fracture events. A welding, mixing of atoms and/or exchange of molecules occurs at the interfaces of colliding particles to promote reactivity. If necessary, liquid reactants, such as toxic materials in liquid form, may be adsorbed on particles of an activated material, such as, for example, activated clay, activated carbon, activated alumina or activated diatomatious earth. Initially such inert materials may be activated by a suitable surfactant or thermally activated.

During high intensity ball milling, the temperature in the mill may increase due to the heat generated by some collision processes. The reactants may also be heated, preferably in the range of ambient to 200° C., more preferably ambient to 100° C., to improve the chemical reactivity. However, the process according to the invention is typically a relatively low-temperature process.

The process of the invention is applicable to the disposal of a wide range of toxic compounds including organic and inorganic compounds, halogenated organic compounds such as CFCs, PCBs, DDT, dioxins, hexachlorophenol, chlorobenzenes, dichlorophenol, pentachlorophenol, Dieldrin, Aldrin, and other organochlorinated pesticides (OCPs) such as Chlordane and Heptachlor. Other toxic materials that may be disposed of by the method of the invention include 2,4-D, 2,4,5-T, Paraquat, Diquat, Phorate, Bromicide, carbamates, Atrazine, other herbicides and insecticides, and chemical weapons such as GB (Sarin), GA (Tabun), VX and HD (mustard). The only limitation on the reactants is that there should normally be a negative Gibb's free energy change associated with the mechanochemical reaction, however there may be exceptions to this.

The invention is further described and illustrated by the following examples. These examples are illustrative of a large number of candidate reactions and are not to be construed as limiting the invention in any way.

Loading of the hardened steel vial and all subsequent handling of reactants was carried out in a high purity argon filled glove box.

EXAMPLE 1

DDT (1.5 grams) and calcium oxide (10.9 grams) were milled together with nine 10 mm hardened steel balls in a hardened steel vial for 24 hours using a SPEX Model 8000 mixer/mill. The total mass of the balls was 72 grams and the ball to reactant mass ratio was 5.9:1. At the conclusion of the milling, the product was analysed using X-ray diffraction (XRD), gas chromatography mass spectroscopy (GCMS) and gas chromatography electron capture (GCEC) techniques. The asmilled powder was found to contain calcium oxide and calcium hydroxide by XRD. The GCEC analysis showed that 99.9996% destruction of organochlorines had occurred during milling.

Water was added to the as-milled powder to dissolve the water soluble compounds. The resulting solution was dried and the residue was identified as $CaCl_2$ by XRD. A chloride analysis of the residue indicated that all of the organic chloride had been converted to inorganic chloride during milling. The insoluble material was separated by filtering and subsequently analysed as containing calcium hydroxide and carbon. Hydrochloric acid was added to the insoluble material to dissolve the calcium hydroxide. The resulting insoluble residue was filtered and dried. Pyrolysis gas chromatography showed that no organic compounds remained in the final residue. XRD analysis of the final residue showed only the presence of carbon.

The calcium oxide reagent thus produced end products that are substantially inert. Calcium oxide is particularly attractive as a reagent due to its ready availability in the form of quicklime and its relatively low cost. Significantly, the use of lime as a reagent for the destruction of toxic waste has previously been examined critically by some authorities in the field who have concluded that it has no application to, nor potential for, toxic waste disposal. However, contrary to these findings, when used in the process of the invention, lime and calcium oxide have been found to be highly effective as a reagent in the destruction of toxic materials, as the above and following examples demonstrate.

EXAMPLE 2

PCB (Aroclor 1254) (1.0 grams) and calcium oxide (8.8 grams) were milled together with nine 10 mm hardened steel balls in a hardened steel vial for 12 hours using a SPEX Model 8000 mixer/mill. The total mass of the balls was; 73 grams and the ball to reactant mass ratio was 7.4:1. At the conclusion of the milling the product was analysed using GCMS and GCEC techniques. The GCEC analysis showed that 99.9995% of the PCB starting material was destroyed during milling.

EXAMPLE 3

DDT (1.5 grams) and calcium oxide (10.9 grams) were milled together with twelve 12 mm hardened steel balls in a hardened steel vial for 24 hours using a Fritsch planetary mill. The total mass of the balls was 96 grams and the ball to reactant mass ratio was 5.9:1. At the conclusion of the milling the product was analysed using GCMS and GCEC techniques. The GCEC analysis showed greater than 99.999% destruction of organochlorine.

EXAMPLE 4

DDT (1.0 grams) and calcium oxide (7 grams) were milled together with one hundred and sixty three 6 mm hardened steel balls in an attritor mill for 12 hours. The total mass of the balls was 163 grams and the ball to reactant mass ratio was 20:1. At the conclusion of the milling the product was analysed using GCMS and GCEC techniques. The GCMS analysis detected no chlorinated or organic compounds.

EXAMPLE 5

DDE (0.5 grams) and calcium oxide (3.7 grams) were milled together with nine 10 mm hardened steel balls in a hardened steel vial for 12 hours using a SPEX Model 8000 mixer/mill. The total mass of the balls was 73 grams and the ball to reactant mass ratio was 17.4:1. At various times; during milling samples were removed from the mill and analysed using GCMS and GCEC techniques. FIG. 1 shows the fraction of DDE remaining as a function of the milling time. The GCEC analysis showed that 99.9998% destruction of the organochlorine had occurred.

EXAMPLE 6

Figure 2:
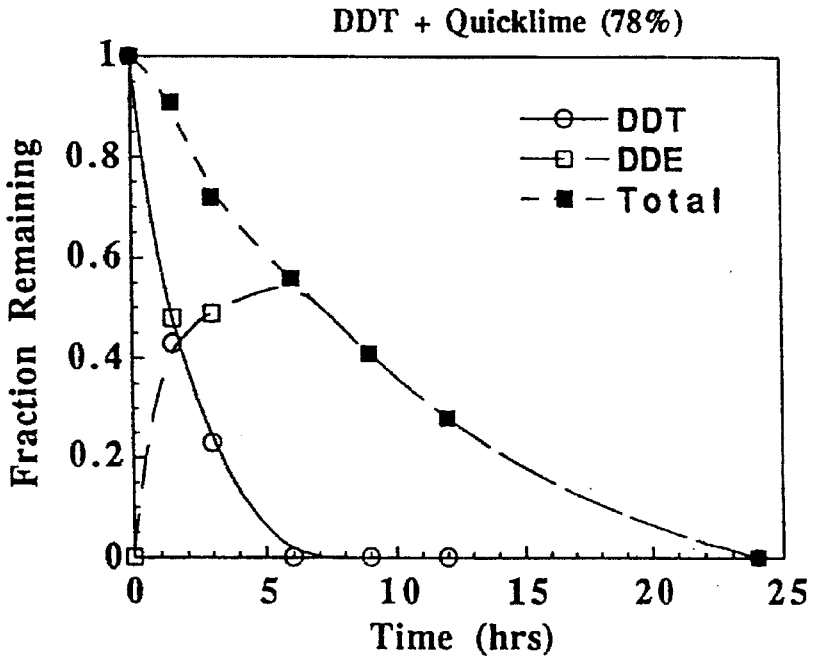
FIG. 2 illustrates graphically the fraction of organochlorines remaining as a function of milling time when processing DDT with quicklime in a ball mill.

DDT (1.5 grams) and quicklime [78% CaO] (13.5 grams) were milled together with nine 10 mm hardened steel balls in a hardened steel vial for 24 hours using a SPEX Model 8000 mixer/mill. The total mass of the balls was 73 grams and the ball to reactant mass ratio was 4.9:1. At various times during milling samples were removed from the mill and. analysed using GCMS and GCEC techniques. FIGS. 2 shows the fraction of organochlorines remaining as a function of the milling time. It is seen that DDE forms as a break-down product of DDT. Complete destruction of the DDT was found to occur after 6 hours and DDE after 24 hours.

EXAMPLE 7

Figure 3:
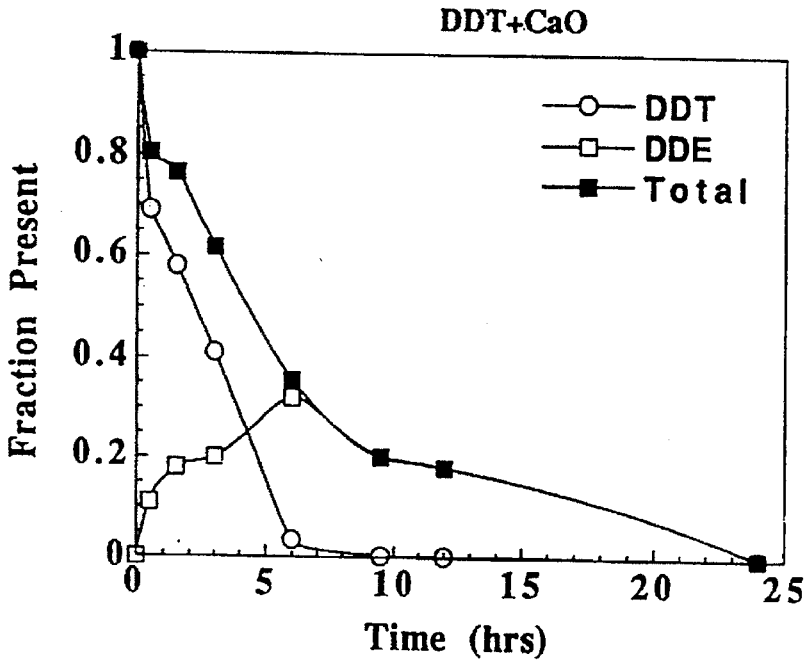
FIG. 3 illustrates graphically the fraction of organochlorines remaining as a function of milling time when processing DDT with CaO in a ball mill.

DDT (1.5 grams) and calcium oxide (11 grams) were milled together with nine 10 mm hardened steel balls in a hardened steel vial for 24 hours using a SPEX Model 800 mixer/mill. The total mass of the balls was 73 grams and the ball to reactant mass ratio was 5.9:1. At various times during milling samples were removed from the mill and analysed using GCMS and GCEC techniques. FIG. 3 shows the fraction of organochlorines remaining as a function of the milling time. It is seen that DDE forms as a break-down product of DDT. Complete destruction of the DDT was found to occur after 10 hours and DDE after 24 hours.

EXAMPLE 8

Figure 4:
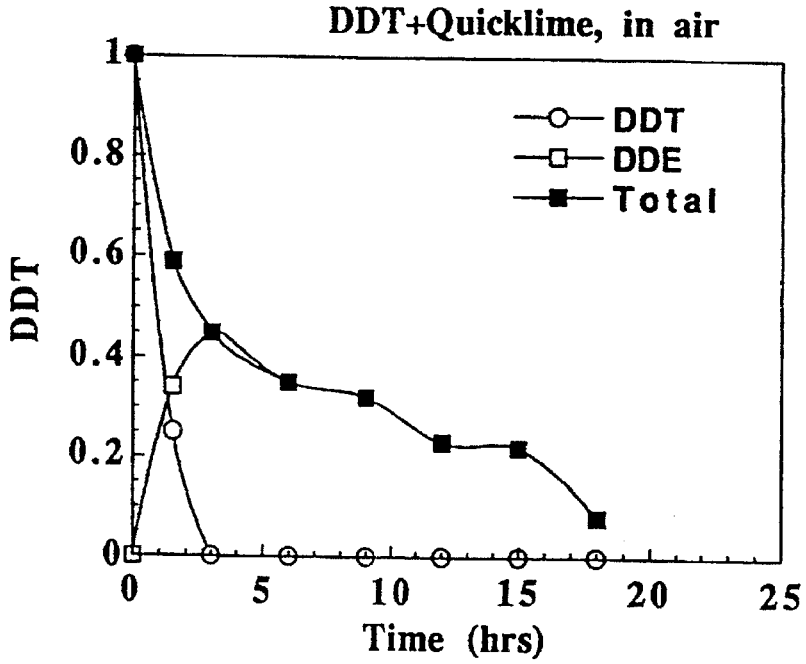
FIGS. 4 and 5 illustrate graphically the fraction of organochlorines remaining as a function of milling time when processing DDT with quicklime in a ball mill.

DDT (1.5 grams) and quicklime [78% CaO] (13.4 grams) were milled together with nine 10 mm hardened steel balls in a hardened steel vial for 24 hours using a SPEX Model 800 mixer/mill. The total mass of the balls was 73 grams and the ball to reactant mass ratio was 4.9:1. The milling was carried out with the reactants exposed to an air atmosphere. At various times during milling samples were removed from the mill and analysed using GCMS and GCEC techniques. FIG. 4 shows the fraction of organochlorines remaining as a function of the milling time. It is seen that DDE forms as a break-down product of DDT. The measurements indicate that complete destruction of the DDT occurs after 3 hours and DDE after approximately 20 hours.

EXAMPLE 9

Figure 5:
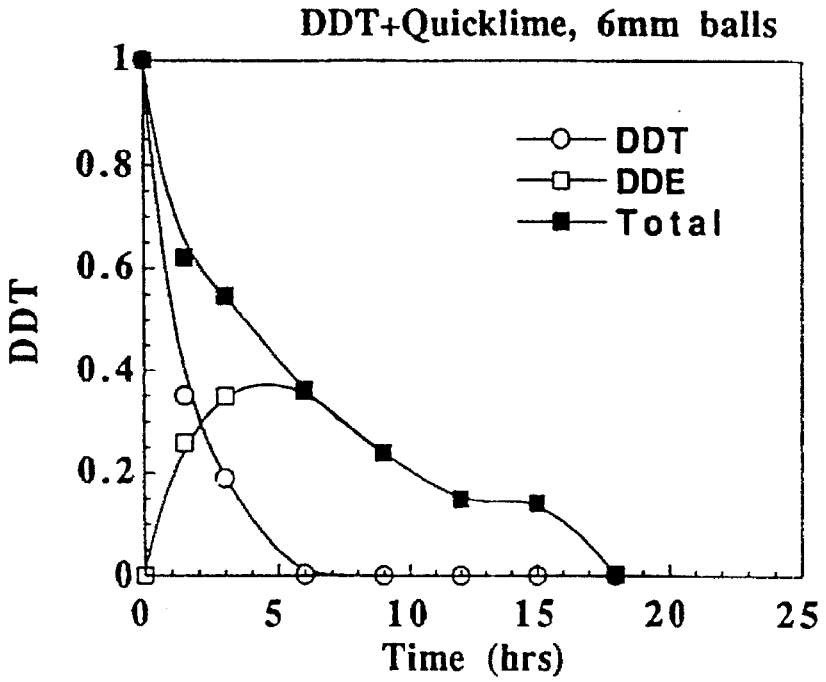

DDT (1.5 grams,) and quicklime [78% CaO] (13.5 grams) were milled together with seventy 6 mm hardened steel balls in hardened steel vial for 24 hours using a SPEX Model 800 mixer/mill. The total mass of the balls was 73 grams and the ball to reactant mass ratio was 4.9:1. At various times during milling samples were removed from the mill and analysed using GCMS and GCEC techniques. FIG. 5 shows the fraction of organochlorines remaining as a function of the milling time. It is seen that DDE forms as a break-down product of DDT. Complete destruction of the DDT was found to occur after 6 hours and DDE after 18 hours.

EXAMPLE 10

Monochlorobenzene (1.1 grams) and calcium oxide (8.0 grams) were milled together with nine 10 mm hardened steel balls in a hardened steel vial for 36 hours using a SPEX Model 8000 mixer/mill. The total mass of the balls was 73 grams and the ball to reactant mass ratio was 8:1. At the conclusion of the milling, the product was analysed using GCMS and GCEC techniques. The GCEC analysis showed 99.9993% destruction of organochlorines.

EXAMPLE 11

Dichlorobenzene (1.02 grams) and calcium oxide (7.0 grams) were milled together with nine 10 mm hardened steel balls in a hardened steel vial for 24 hours using a SPEX Model 800 mixer/mill. The total mass of the balls was 73 grams and the ball to reactant mass ratio was 9.1:1. At the conclusion of the milling, the product was analysed using GCMS and GCEC techniques. The GCEC analysis showed 99.9969% destruction of organochlorines.

EXAMPLE 12

Hexachlorobenzene (1.06 grams) and calcium oxide (7.98 grams) were milled together with nine 10 mm hardened steel balls in a hardened steel vial for 12 hours using a SPEX Model 8000 mixer/mill. The total mass of the balls was 73 grams and the ball to reactant mass ratio was 8:1. At the conclusion of the milling, the product was analysed using GCMS and GCEC techniques. The GCEC analysis showed 99.9994% destruction of organochlorines.

EXAMPLE 13

Chlorpyrifos ($C_9H_{11}NO_3Cl_3PS$) (1.01 grams) and calcium oxide (7.08 grams) were milled together with ten 12 mm hardened steel balls in a hardened steel vial for 24 hours using a SPEX Model 8000 mixer/mill. The total mass of the balls was 81 grams and the ball to reactant mass ratio was 10:1. At the conclusion of the milling, the product was analysed using GCMS and GCEC techniques. The GCEC analysis showed greater than 99.9998% destruction of organic compounds.

EXAMPLE 14

Atrazine ($C_8H_{14}N_5Cl$) (1.0 grams) and calcium oxide (7.02 grams) were milled together with ten 12 mm hardened steel balls in a hardened steel vial for 24 hours using a SPEX Model 8000 mixer/mill. The total mass of the balls was 72 grams and the ball to reactant mass ratio was 10.1:1. At the conclusion of the milling, the product was analysed using GCMS and GCEC techniques. The GCEC analysis showed greater than 99.99% destruction-of organics.

EXAMPLE 15

Fenitrothion ($C_9H_{12}NO_5P$) (0.95 grams) and calcium oxide (6.63 grams) were milled together with ten 12 mm hardened steel balls in a hardened steel vial for 24 hours using a SPEX Model 8000 mixer/mill. The total mass of the balls was 81 grams and the ball to reactant mass ratio was 10.7:1. At the conclusion of the milling, the product was; analysed using GCMS and GCEC techniques. The GCEC analysis: showed 99.9996% destruction of organic compounds.

EXAMPLE 16

Benzene ($C_6H_6$) (0.86 grams) and calcium oxide (7.0 grams) were milled together with nine 12 mm hardened steel balls in a hardened steel vial for 48 hours using a SPEX Model 8000 mixer/mill. At the conclusion of the milling, the product was analysed using GCMS analysis. The GCMS analysis did not detect any organic compounds.

EXAMPLE 17

Paraffin Oil (1.01 grams) and metallurgical grade quicklime [78% CaO] (14.24 grams) were milled together with ten 12 mm hardened steel balls in a hardened steel vial for 24 hours using a SPEX Model 8000 mixer/mill. At the conclusion of the milling, the product was analysed using GCMS analysis. The GCMS analysis did not detect any organic compounds.

EXAMPLE 18

Benzophenone ($C_{13}H_{10}O$) (1.00 grams) and CaO (7.03 grams) were milled together with ten 12 mm hardened steel balls in a hardened steel vial for 48 hours using a SPEX Model 8000 mixer/mill. At the conclusion of the milling, the product was analysed using GCMS analysis. The GCMS analysis did not detect any organic compounds.

EXAMPLE 19

Anthracene ($C_{14}H_{10}$) (0.99 grams) and CaO (6.98 grams) were milled together with eighty one 6 mm hardened steel balls in a hardened steel vial for 48 hours using a SPEX Model 8000 mixer/mill. At the conclusion of the milling, the product was analysed using GCMS analysis. The GCMS analysis did not detect any organic compounds.

EXAMPLE 20

Dicyanobenzene ($C_8H_4N_2$) (0.98 grams) and CaO (6.99 grams) were milled together with eighty one 6 mm hardened steel balls in a hardened steel vial for 48 hours using a SPEX Model 8000 mixer/mill. At the conclusion of the milling, the product was, analysed using GCMS analysis. The GCMS analysis did not detect any organic compounds.

EXAMPLE 21

DDT (2.0 grams) and magnesium metal (2.45 grams) were milled together with nine 10 mm hardened steel balls in a hardened steel vial for 12 hours using a SPEX Model 8000 mixer/mill. The total mass of the balls was 90 grams and the ball to reactant mass ratio was 20.2:1. At the conclusion of the milling the product was analysed using GCMS and X-ray diffraction (XRD). The GCMS analysis did not detect any organochlorine, indicating that complete destruction had occurred during milling. Chloride analysis of the as-milled powder using Volhard's method showed that all of the organic chlorine had been converted into inorganic chloride. The organic molecules of DDT thus appear to have reacted with the magnesium metal during milling and were converted into simple inorganic compounds.

After heating to 600° C. in vacuum the powder was found by XRD to contain magnesium carbide and magnesium chloride. Magnesium hydride is known to decompose at temperatures below 600° C. and was thus not detected by XRD.

EXAMPLE 22

Agricultural DDT in a toluene solvent [25% DDT] (7.96 grams) and magnesium (4.97 grams) were milled together with eight 10 mm hardened steel balls in a hardened steel vial for 24 hours using a SPEX Model 800 mixer/mill. The total mass of the balls was 65 grams and the ball to reactant mass ratio was 5:1. At the conclusion of the milling, the crumbly paste product was analysed using GCMS analysis. Except for the toluene from the solvent the GCMS analysis detected no trace of the DDT starting material or any other chlorinated or organic compounds.

EXAMPLE 23

DDT (2.01 grams), sodium hydroxide (2.54 grams) and graphite (0.25 grams) were milled together with eight 10 mm hardened steel balls in a hardened steel vial for 12 hours using a SPEX Model 8000 mixer/mill. The total mass of the balls was 65 grams and the ball to reactant mass ratio was 13.5:1. At the conclusion of the milling, the product was analysed using X-ray diffraction and GCMS. The as-milled powder was found to contain sodium hydroxide monohydrate and sodium chloride by X-ray diffraction. The GCMS analysis detected that dechlorination had occurred.

EXAMPLE 24

DDT (0.99 grams) and MgO (6.97 grams) were milled together with ten 12 mm hardened steel balls in a hardened steel vial for 24 hours using a SPEX Model 8000 mixer/mill. The total mass of the balls was 81 grams and the ball to reactant mass ratio was 10.2:1. At the conclusion of the milling, the product was analysed using GCMS and GCEC techniques. The GCEC analysis showed 99.98% destruction of organochlorine.

EXAMPLE 25

DDT (1.01 grams) and $Fe_2O_3$ (7.0 grams) were milled together with eighty one 6 mm hardened steel balls in a hardened steel vial for 24 hours using a SPEX Model 8000 mixer/mill. The total mass of the balls was 81 grams and the ball to reactant mass ratio was 10.1:1. At the conclusion of the milling, the product was analysed using GCMS and GCEC techniques. The GCEC analysis showed 89% destruction of DDT (including DDD and DDE).

EXAMPLE 26

DDT (1.00 grams) and CuO (6.95 grams) were milled together with ten 12 mm hardened steel balls in a hardened steel vial for 24 hours using a SPEX Model 8000 mixer/mill. The total mass of the balls was 81 grams and the ball to reactant mass ratio was 10.2:1. At the conclusion of the milling, the product was analysed using GCMS and GCEC techniques. The GCEC analysis showed 89% destruction of DDT. Copper metal was found on the balls after milling, indicating that the reduction of CuO to metallic copper occurred during milling.

EXAMPLE 27

DDT (1.00 grams) and $Al_2O_3$ (6.99 grams) were milled together with eighty one 6 mm hardened steel balls in a hardened steel vial for 24 hours using a SPEX Model 8000 mixer/mill. The total mass of the balls was 81 grams and the ball to reactant mass ratio was 10.1:1. At the conclusion of the milling, the product was analysed using GCMS and GCEC techniques. The GCEC analysis showed 85% destruction of DDT (including DDD and DDE).

EXAMPLE 28

DDT (1.00 grams) and a sample of 'Red Mud' (7.03 grams) from an Alumina refinery were milled together with eighty one 6 mm hardened steel balls in a hardened steel vial for 24 hours using a SPEX Model 8000 mixer/mill. The total mass of the balls was 81 grams and the ball to reactant mass ratio was 10.1:1. At the conclusion of the milling, the product was analysed using GCMS and GCEC techniques. The GCEC analysis showed 84% destruction of DDT (including DDD and DDE).

EXAMPLE 29

DDT (1.00 grams) and $Fe_2O_3$ (7.3 grams) and CaO (9.91 grams) were milled together with eight 12 mm hardened steel balls in a hardened steel vial for 21 hours using a SPEX Model 8000 mixer/mill. The total mass of the balls was 64.9 grams and the ball to reactant mass ratio was 3.6:1. At the conclusion of the milling, the product was analysed using GCMS and GCEC techniques. The GCEC analysis showed 99.99% destruction of DDT (including DDD and DDE).

EXAMPLE 30

DDT (1.01 grams) and CaO (0.89 grams) were milled together with nine 12 mm hardened steel balls in a hardened steel vial for 24 hours using a SPEX Model 8000 mixer/mill. In a second experiment DDT (1.01 grams) and CaO (0.88 grams) were milled with Al (0.11 grams) using the same conditions. At the conclusion of the two millings, the products were analysed using GCMS and GCEC techniques. The GCEC analysis showed 99.994% destruction of organochlorine occurred in the sample which contained the addition of 0.11 grams of Al, while in the sample not containing the Al addition only 28.8% of the organochlorine was destroyed. These results indicate that the ratio of CaO to DDT can be greatly reduced (compare with Examples 3 to 9) by the addition of a small quantity of metal such as Aluminium as one of the reactants. The addition of Fe and Ni had little effect.

EXAMPLE 31

PCB (Aroclor 1254) (3.0 grams) and magnesium metal (3.0 grams) were milled together with nine 10 mm hardened steel balls in a hardened steel vial for 12 hours using a SPEX Model 8000 mixer/mill. The total mass of the balls was 90 grams and the ball to reactant mass ratio was 15:1. At the conclusion of the milling, the product was analysed using GCMS and GCEC techniques. The GCEC analysis showed that 99.97% of the PCB starting material was destroyed during milling. The organic molecules of PCB had thus reacted with the magnesium metal during milling and were converted into simple inorganic compounds.

EXAMPLE 32

Monochlorobenzene (1.0 grams) and calcium metal (5.0 grams) were milled together with nine 10 mm hardened steel balls in a hardened steel vial for 12 hours using a SPEX Model 8000 mixer/mill. The total mass of the balls was 90 grams and the ball to reactant mass ratio was 15:1. At the conclusion of the milling, the product was analysed using X-ray diffraction (XRD), Fourier transform infra-red spectroscopy and GCMS techniques. The as-milled powder was found to be amorphous. GCMS analysis did not detect any trace of the monochlorobenzene starting material. After heating to 700° C. in vacuum to crystallise the constituents the powder was found by XRD to consist of calcium hydride, calcium chloride-and calcium carbide.

The organic molecules of monochlorobenzene had thus reacted with the calcium metal during milling and were converted into simple inorganic compounds.

EXAMPLE 33

DDT (2 grams) and calcium metal (3.2 grams) were milled together with nine 10 mm hardened steel balls in a hardened steel vial for 12 hours using a SPEX Model 8000 mixer/mill. The total mass of the balls was 90 grams and the ball to reactant mass ratio was 17.3:1. At the conclusion of the milling, the product was analysed using GCMS techniques; The as-milled powder was found to be free of all organic: matter to the resolution of the instrument (nanograms). The organic molecules of DDT had thus reacted with the calcium metal during milling and were converted into simple inorganic compounds.

EXAMPLE 34

PCB (Aroclor 1254) (1.9 grams) and aluminium metal (3.6 grams) were milled together with nine 10 mm hardened steel balls in a hardened steel vial for 12 hours using a SPEX Model 8000 mixer/mill. The total mass of the balls was 90 grams and the ball to reactant mass ratio was 16.4:1. At the conclusion of the milling, the product was analysed using GCMS and GCEC techniques. The GCEC analysis showed that 99.95% of the PCB starting material was destroyed during milling. The organic molecules of PCB had thus reacted with the aluminium metal during milling and were converted into simple inorganic compounds.

EXAMPLE 35

DDT (1.0 grams) and iron metal (4.5 grams) were milled together with nine 10 mm hardened steel balls in a hardened steel vial for 12 hours using a SPEX Model 8000 mixer/mill. The total mass of the balls was 90 grams and the ball to reactant mass ratio was 16.4:1. At the conclusion of the milling, the product was analysed using GCMS and GCEC techniques. The GCEC analysis showed that 96.4% of the DDT starting material was destroyed during milling. The organic molecules of DDT had thus reacted with the iron metal during milling and were converted into simple inorganic compounds.

EXAMPLE 36

DDT (1.0 grams), calcium metal (0.7 grams) and iron metal (4.0 grams) were milled together with nine 10 mm hardened steel balls in a hardened steel vial for 12 hours using a SPEX Model 8000 mixer/mill. The total mass of the balls was 90 grams and the ball to reactant mass ratio was 15.8:1. At the conclusion of the milling, the product was analysed using GCMS analysis. The GCMS analysis detected no organochlorines, indicating that practically total destruction of DDT occurred during milling.

In view of the importance of CaO as a preferred reagent several ways of further enhancing the reactivity off the reactants were investigated when using CaO as the, or one of the, reagents. In particular, the effect of pre-milling the CaO prior to mechanical activation with a toxic material, the effect of incremental addition of the CaO and/or the toxic material to the reactants during milling and the effect of raising the temperature of the reactants were all investigated. In several cases, a marked improvement in the reactivity, evidenced by reduced milling times was achieved, The following examples illustrate the effect of pre-milling, incremental addition of reactants and heating.

EXAMPLE 37

Figure 6:
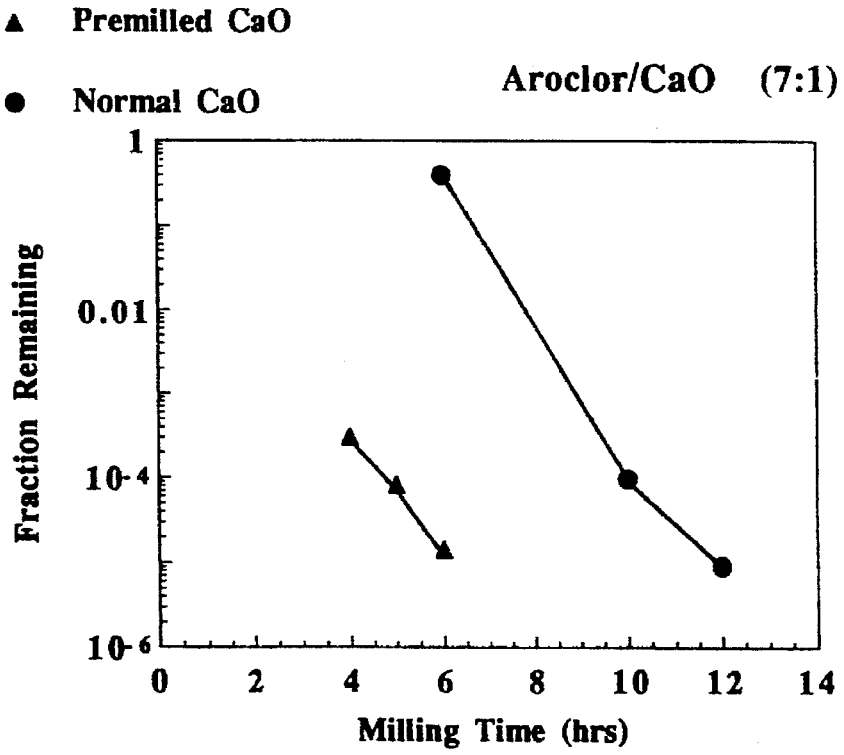
FIG. 6 illustrates graphically the reduced milling time that can be achieved using pre-milled CaO; and, FIG. 7 illustrates graphically the fraction of PCB remaining when the PCB is added incrementally during milling.

Mixtures of PCB (Aroclor 1254) (~1 grams) and calcium oxide (~7 grams) were milled together with eighty one 6 mm hardened steel balls in a hardened steel vial for 8–12 hours using a SPEX Model 8000 mixer/mill. In a second set of tests CaO (8.5 grams) was pre-milled with nine 10 mm hardened steel balls in a hardened steel vial for 12 hours in a SPEX Model 8000 mixer/mill. The purpose of premilling being to reduce the CaO particle size. Mixtures of PCB (Aroclor 1254) (~1 grams) and the pre-milled calcium oxide (~7 grams) were then milled together with nine 10 mm hardened steel balls in a hardened steel vial for 4–6 hours using a SPEX Model 8000 mixer/mill. At the conclusion of the milling, the products were analysed using GCMS and GCEC techniques. The effect of milling time on the fraction of PCB remaining is shown in FIG. 6. It is seen that pre-milling of the CaO decreased the milling time required for a given level of destruction by a factor of approximately one half.

EXAMPLE 38

Figure 7:
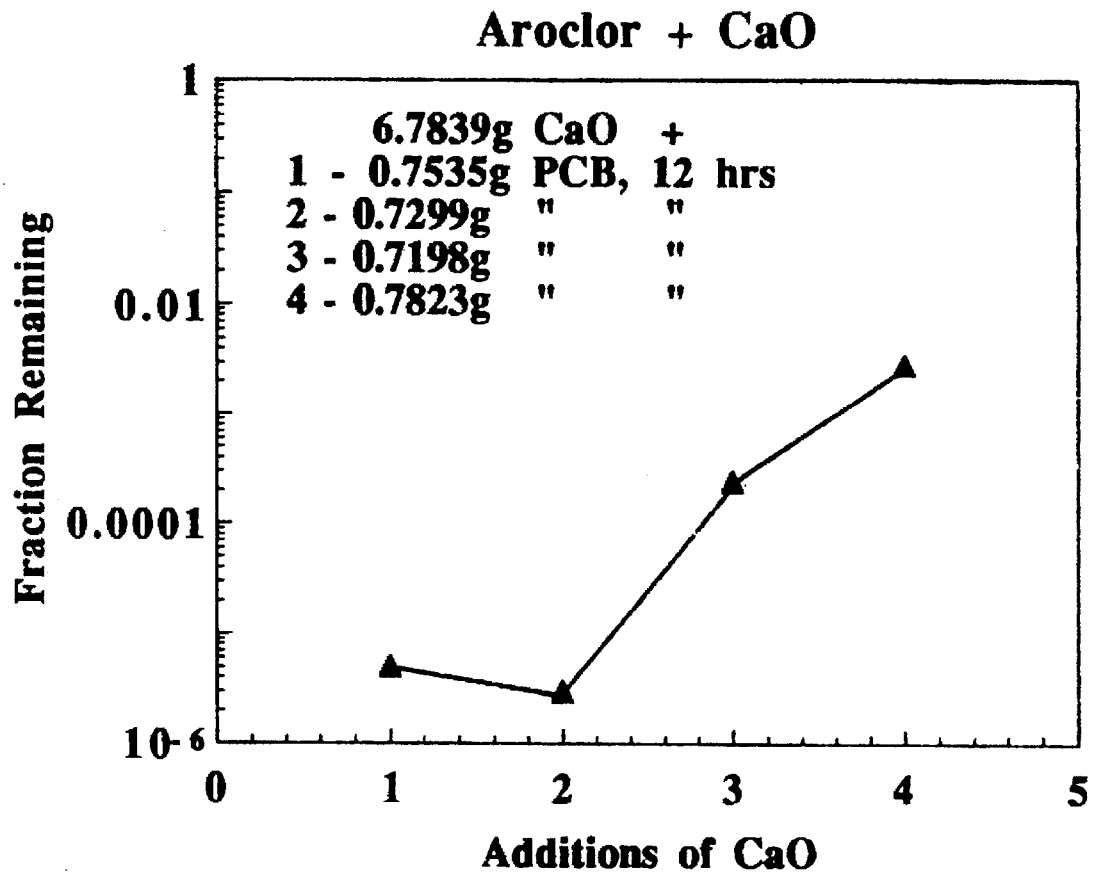

PCB (Aroclor 1254) and calcium oxide were milled together with nine 10 mm hardened steel balls in a hardened steel vial using a SPEX Model 8000 mixer/mill. The initial charge consisted of 6.78 grams of CaO and 0.75 grams PCB. After 12 hours milling a small sample (0.1 grams) was removed for analysis and a further 0.73 grams of PCB was added and milling then continued for an additional 12 hours. Similarly, samples were removed and additions of PCB of 0.72 grams and 0.78 grams, respectively, were made after 24 and 36 hours milling. The samples were analysed using GCMS and GCEC techniques. FIG. 7 shows the fraction of PCB, as measured by GCEC, remaining at the end of each of the four milling periods associated with the additions of PCB (i.e. after 12, 24, 36, 48 hours milling). Table 1 gives values of the per cent destruction of PCB and the effective CaO/PCB mass ratio after each 12 hour period. The measurements show that the sequential addition of PCB results in a significant reduction in the weight ratio of CaO to PCB required to achieve destruction of PCB.

TABLE 1

| | Milling Time (hours) | CaO/PCB Mass Ratio | Destruction % |
|---|---|---|---|
| 1. | 12 | 9:1 | 99.9995 |
| 2. | 24 | 4.6:1 | 99.9997 |
| 3. | 36 | 3.1:1 | 99.976 |
| 4. | 48 | 2.3:1 | 99.72 |

A similar effect may be achieved by reusing excess; CaO remaining after destruction of the toxic material as part of the reactants for the following batch of toxic material to be treated. Thus, for example, with an initial charge having a reagent/toxic material ratio of 12:1, 3 units of the reactants could be removed following milling and replaced with 2 units of reagent and 1 unit of toxic material. Milling is recommenced until substantially all of the toxic material is destroyed and then the process is repeated. This allows an increased number of batches or charges to be milled before the reagent/toxic material ratio falls to an unacceptably low level. A much better cumulative reagent consumption ratio can be achieved. In this example, after 9 charges the reagent/toxic material ratio falls below 7, but the cumulative reagent consumption ratio is only 4.62:1. Combined with pre-milling or an ultrafine particle size of the reagent, a significant reduction in the reagent consumption during destruction of the toxic materials can be achieved.

EXAMPLE 39

DDT (0.92 grams) and CaO (7.39 grams) were milled together with ten 12 mm hardened steel balls in a hardened steel vial for 8 hours using a SPEX Model 8000 mixer/mill. During milling the external surface of the vial was kept at 100° C. by the use of a heater. At the conclusion of the milling, the product was analysed using GCMS and GCEC techniques. The GCEC analysis showed 99.9986% destruction of organochlorine. This result shows that destruction of the DDT was greatly accelerated by heating, compared to milling at room temperature.

The process of the invention can be readily applied on a large scale to facilitate commercially viable toxic material disposal. A suitably sealed mechanical mill of the kind commonly available, for example a rotary type ball mill, can be employed to perform the mechanical activation. Such a mill may be permanently located at a prescribed toxic material disposal site, or a smaller transportable version may be mounted on a truck for transport to the locations of toxic materials. The toxic material is introduced into the mill with appropriate grinding media and a reagent, and the mixture is subjected to milling for a predetermined time period or until such time as sample analysis indicates no detectable levels of the toxic material remain in the mill. Any quantity of toxic material can be processed in this way using a batch feed technique. Closed circuit recycling of the mill contents between the mill and an external vessel may be desirable in some circumstances. Post-milling processing may also be performed to extract the non-toxic end products and/or to facilitate recycling of some end products.

The mechanically activated process for the disposal of toxic materials described above has a number of significant advantages over conventional disposal methods, including the following:

1. The process is simple and does not require the simultaneous functioning of a large number of interconnected systems and components to operate. This lowers the overall risk associated with the process.
2. The process can be carried out in a closed system which is advantageous in controlling the risk of any emissions of toxic materials.
3. The process can be operated at conditions close to ambient and thus does not present a high risk for catastrophic emission of toxic materials.
4. The process is intrinsically robust and its safety will not be compromised by events such as power failure or drive failure or weather conditions. It can be stopped or started as desired. It can be operated without reliance on real time electronic process control systems. These factors lower the risk associated with use of the process.
5. The process is applicable to a wide variety of liquid or solid toxic materials.
6. The process can be relocatable and therefore can be used to treat toxic materials on site, and the risks associated with the transport of toxic materials are eliminated.
7. The process does not require extensive disassembly, reassembly or recommissioning when moved. This lowers the risks associated with these operations.
8. The end products of the process are typically non-toxic inorganic materials which can be easily disposed of or even recycled.
9. The process can, in some cases, potentially be used to dispose of both the toxic material and its container at the same time, thus eliminating a handling stage and the associated risks.
10. The process bears no resemblance to incineration, and is therefore not liable to be perceived to be unacceptable by the drawing of comparisons with incineration.

Now that preferred embodiments of the invention have been described in detail, it will be apparent to persons skilled in the relevant arts that numerous variations and modifications can be made without departing from the basic inventive concepts. All such modifications and variations are considered to be within the scope of the present invention, the nature of which is to be determined from the foregoing description and appended claims. Furthermore, the preceding examples are provided to illustrate specific embodiments of the invention and are not intended to limit the scope of the process of the invention.

The claim defining the invention are as follows:

1. A mechanochemical process for the treatment of a liquid or solid organic toxic material to form a non-toxic end product, the process comprising:

subjecting a solid-solid or liquid-solid mixture of the organic toxic material and a suitable reagent to mechanical activation to increase the chemical reactivity of the reactants such that a chemical reaction occurs during mechanical activation which is accompanied by substantial destruction of the organic toxic material.

2. A process as claimed in claim 1 wherein the organic material is a halogenated organic compound.

3. A process as claimed in claim 2, wherein the halogenated organic compound is selected from the group consisting of CFCs, PCBs, DDT, dioxins, hexachlorophenol, chlorobenzenes, dichlorophenol, pentachlorophenol, dieldrin, Aldrin, Chlordane and Heptachlor.

4. A process as claimed in claim 1, wherein the organic material is an organophosphorus compound.

5. A process as claimed in claim 1, wherein subjecting the mixture to mechanical activation results in a mechanochemical reaction between the toxic material and the reagent and wherein the reactants are selected so that there will be a negative Gibb's free energy change associated with the mechanochemical reaction between the toxic material and the reagent.

6. A process as claimed in claim 5, wherein the reagent is a reducing agent selected from the group consisting of aluminium metal, iron metal and zinc metal and mixtures thereof.

7. A process as claimed in claim 5, wherein the reagent is an oxidizing agent selected from the group consisting of iron oxide, manganese dioxide and oxygen.

8. A process as claimed in claim 5, wherein the reagent is selected from the group consisting of sodium hydroxide, graphite, red mud, lime, quicklime, water, carbon dioxide, calcium oxide, copper oxide, aluminium oxide and magnesium oxide.

9. A process as claimed in claim 6, wherein the reagent is aluminium metal.

10. A process as claimed in claim 5, wherein the mechanical activation is performed inside a mechanical mill.

11. A process as claimed in claim 10, wherein the mechanical mill is a ball mill.

12. A process as claimed in claim 7, wherein a particle size of the reagent is reduced so as to increase the reaction surface area of the reagent prior to subjecting a mixture of the toxic material and the reagent to mechanical activation.

13. A process as claimed in claim 1, wherein after mechanical activation of the toxic material and reagent to form a chemical reaction mixture, portions of said chemical reaction mixture are periodically removed and replaced with fresh reagent and more toxic material whereby, the total quantity of reagent required is substantially reduced.

14. A process as claimed in claim 1, wherein the toxic material comprises a chemical weapon selected from the group consisting of GB, GA, VX and HD.

15. A process as claimed in claim 1, wherein the reactants are subjected to heating to further increase the chemical reactivity.

16. A process as claimed in claim 15, wherein the reactants are heated to a temperature which is maintained in the range of ambient to 200° C.

* * * * *

UNITED STATES PATENT AND TRADEMARK OFFICE
CERTIFICATE OF CORRECTION

PATENT NO. : 5,648,591

DATED : July 15, 1997

INVENTOR(S) : Donecker et al.

It is certified that error appears in the above-identified patent and that said Letters Patent is hereby corrected as shown below:

In column 7, line 27: "800" should read --8000--.

In column 7, line 41: "800" should read --8000--.

In column 7, line 55: "800" should read --8000--.

In column 8, line 12: "800" should read --8000--.

In column 9, line 65: "800" should read --8000--.

In column 11, line 60: delete "-" immediately after the word "chloride".

In column 12, line 6: delete ":" immediately after the word "organic".

In column 13, line 45: delete ";" immediately after the word "excess".

In column 15, line 27, claim 3: "dieldrin" should read --Dieldrin--.

In column 16, line 17, claim 12: "7" after the word "Claim" should read --6--.

Signed and Sealed this

Tenth Day of March, 1998

*Attest:*

Bruce Lehman

BRUCE LEHMAN

*Attesting Officer*

*Commissioner of Patents and Trademarks*